US009611705B2

(12) United States Patent
Buytaert et al.

(10) Patent No.: US 9,611,705 B2
(45) Date of Patent: Apr. 4, 2017

(54) CENTRALIZER PRECONDITIONING AND TESTING APPARATUS AND METHOD

(71) Applicants: Jean Buytaert, Mineral Wells, TX (US); Ira Hining, Houston, TX (US); Clayton Plucheck, Tomball, TX (US)

(72) Inventors: Jean Buytaert, Mineral Wells, TX (US); Ira Hining, Houston, TX (US); Clayton Plucheck, Tomball, TX (US)

(73) Assignee: ANTELOPE OIL TOOL & MFG. CO., Mineral Wells, TX (US)

( * ) Notice: Subject to any disclaimer, the term of this patent is extended or adjusted under 35 U.S.C. 154(b) by 527 days.

(21) Appl. No.: 14/052,496

(22) Filed: Oct. 11, 2013

(65) Prior Publication Data

US 2015/0101798 A1 Apr. 16, 2015

(51) Int. Cl.

| | |
|---|---|
| ***E21B 19/00*** | (2006.01) |
| ***E21B 47/00*** | (2012.01) |
| ***E21B 17/10*** | (2006.01) |

(52) U.S. Cl.

CPC ..... *E21B 19/00* (2013.01); *E21B 17/1028* (2013.01); *E21B 47/0006* (2013.01)

(58) Field of Classification Search

CPC ... E21B 17/1028; E21B 19/00; E21B 47/0006
See application file for complete search history.

(56) References Cited

U.S. PATENT DOCUMENTS

| | | | | |
|---|---|---|---|---|
| 4,787,458 | A * | 11/1988 | Langer | E21B 17/1028 166/380 |
| 2002/0117307 | A1 | 8/2002 | Bystedt | |
| 2009/0159295 | A1 | 6/2009 | Guerrero et al. | |
| 2010/0326671 | A1 | 12/2010 | Buytaert et al. | |
| 2011/0186289 | A1 | 8/2011 | Buytaert et al. | |
| 2013/0025881 | A1 | 1/2013 | Buytaert et al. | |
| 2013/0248206 | A1 | 9/2013 | Jordan et al. | |

FOREIGN PATENT DOCUMENTS

| | | |
|---|---|---|
| WO | 2011096820 A2 | 8/2011 |

OTHER PUBLICATIONS

Hun Gil Lee (Authorized Officer), PCT International Search Report and Written Opinion dated Jan. 27, 2015, International Application No. PCT/US2014/058963, filed Oct. 3, 2014, pp. 1-10.

* cited by examiner

*Primary Examiner* — William P Neuder
(74) *Attorney, Agent, or Firm* — MH2 Technology Law Group, LLP

(57) ABSTRACT

Apparatus, methods, and systems for preconditioning and/or testing a centralizer, and a preconditioned centralizer, are provided. The apparatus includes a restrictor positionable around a tubular and having an inner diameter that is greater than an outer diameter of the tubular. The apparatus also includes a driver configured to translate the restrictor relative to the tubular in at least a first axial direction. The restrictor is configured to engage a centralizer attached to the tubular, and the restrictor is configured to at least partially collapse flexible ribs of the centralizer when the driver axially translates the restrictor across at least a portion of the flexible ribs.

36 Claims, 10 Drawing Sheets

CENTRALIZER PRECONDITIONING AND TESTING APPARATUS AND METHOD

BACKGROUND

Centralizers may be installed on tubulars, generally as part of a drill or casing string in an oilfield context, to provide an annular standoff between the tubulars and a surrounding tubular (e.g., wellbore). Centralizers can provide this standoff using blades or ribs that extend radially outward from the tubulars. One type of centralizer employs flexible, bow-shaped ribs or "bow springs," which resiliently engage the surrounding tubular. Such bow-spring centralizers may be capable of providing a standoff across a range of diameters of the wellbore, and may collapse radially to pass through restrictions or obstructions (i.e., areas of reduced diameter in the wellbore).

Various processes, including heat treating and tempering, are employed to give the bow springs the resiliency that allows them to elastically deform when confronted with reductions in wellbore diameter, and to spring back once these restrictions are passed. However, the first time the centralizer passes through a restriction, the bow springs may yield and experience an amount of plastic deformation. This yielding can affect the starting, running, and/or restoring forces, among other things, which characterize the performance of the bow springs, according to industry standards. Further, such yielding can potentially compromise the integrity of the bow spring, which may result in off-design performance, shortened life, and/or failure.

Further, accurate information regarding the performance of a particular centralizer in actual wellbore conditions may be difficult to collect, prior to running the centralizer into the wellbore. Current standards allow a tolerance of 1% in the diameter of the tubular, which defines, or at least contributes to, a radial end range for collapse of the bow springs of the centralizer. Especially in large diameter tubing applications, this tolerance may be sufficient to affect the yielding of the centralizer. As such, measuring the characteristics of the centralizer in a test stand may be inaccurate, as the actual dimensions of the tubular upon which the centralizer will be disposed may not be known beyond the standard tolerance. Thus, uncertainties as to the performance of the centralizer in the wellbore may exist, despite testing efforts.

SUMMARY

Embodiments of the disclosure may provide an apparatus. The apparatus may include a restrictor positionable around a tubular and having an inner diameter that is greater than an outer diameter of the tubular. The apparatus may also include a driver configured to translate the restrictor relative to the tubular in at least a first axial direction. The restrictor may be configured to engage a centralizer attached to the tubular, and the restrictor is configured to at least partially collapse flexible ribs of the centralizer when the driver axially translates the restrictor across at least a portion of the flexible ribs.

Embodiments of the disclosure may also provide a method. The method may include positioning a restrictor around a tubular and adjacent to a centralizer attached to the tubular and having flexible ribs. The restrictor may define an effective inner diameter that is less than an outer diameter of the centralizer. The method may also include translating the restrictor with respect to the tubular, at least partially across the centralizer, so as to radially collapse at least a portion of the flexible ribs of the centralizer, which may cause the flexible ribs to yield.

Embodiments of the disclosure may also provide a system. The system may include a restrictor configured to be placed over a tubular having a centralizer. The system may also include a support fixture attached to an end of the tubular. The system may further include a driver attached to the support fixture, the driver being configured to move the restrictor into contact the centralizer. The centralizer may have a first outer diameter prior to contact with the restrictor and a second, smaller outer diameter after contact with the restrictor.

Embodiments of the disclosure may further provide a centralizer. The centralizer may include at least one end collar configured to be received around a tubular. The centralizer may also include a plurality of bow springs attached to the at least one end collar. The plurality of bow springs may be yielded such that the centralizer is configured to apply a predetermined starting force, a predetermined running force, or both prior to be deployed into a wellbore.

It is to be understood that both the foregoing general description and the following detailed description are exemplary and explanatory only and are not restrictive of the present teachings, as claimed.

BRIEF DESCRIPTION OF THE DRAWINGS

The accompanying drawing, which is incorporated in and constitutes a part of this specification, illustrates an embodiment of the present teachings and together with the description, serves to explain the principles of the present teachings. In the figures.

Figure 1:
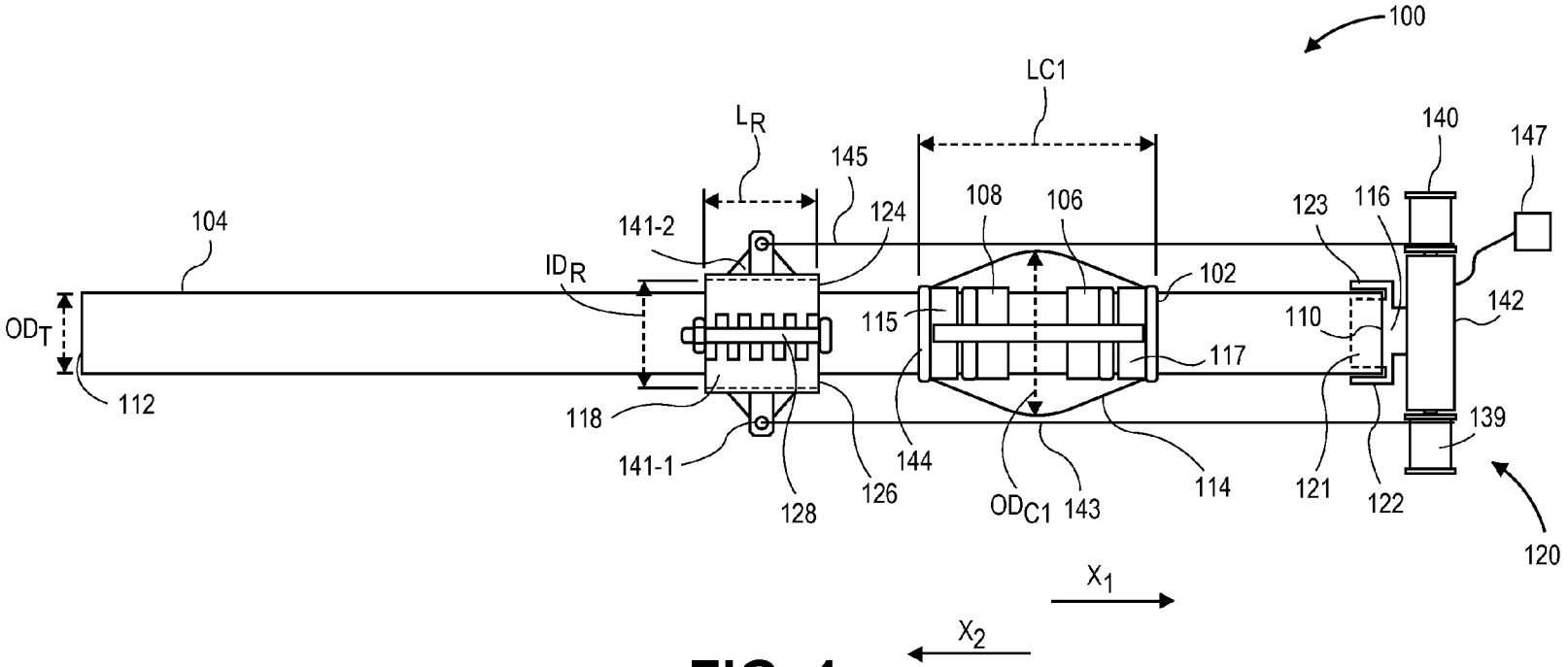
FIG. 1 illustrates a side schematic view of an apparatus for testing and preconditioning a centralizer, according to an embodiment.

It should be noted that some details of the figure have been simplified and are drawn to facilitate understanding of the embodiments rather than to maintain strict structural accuracy, detail, and scale.

DETAILED DESCRIPTION

Reference will now be made in detail to embodiments of the present teachings, examples of which are illustrated in the accompanying drawing. In the drawings, like reference numerals have been used throughout to designate identical elements, where convenient. In the following description, reference is made to the accompanying drawing that forms a part thereof, and in which is shown by way of illustration one or more specific example embodiments in which the present teachings may be practiced.

Further, notwithstanding that the numerical ranges and parameters setting forth the broad scope of the disclosure are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein.

FIG. 1 illustrates a schematic view a system or apparatus 100 for testing and/or preconditioning a centralizer 102, according to an embodiment. For ease of description, this view will be referred to herein as a side view; however, it will be appreciated that the view of FIG. 1 (and similar views) may be representative of a plan or side view, or a view from any other angle, without limitation. As shown, the centralizer 102 may be attached to an outer diameter of a tubular 104. The term "attached," and grammatical equivalents, are generally used herein to refer to any type of connection between two components. It will be appreciated that two components may be connected directly together or via one or more intermediate components without departing from the scope of the definition of "attached," unless otherwise specified herein. Further, two components may be removably or permanently connected together, fixed in position relative to one another, or relatively movable, without departing from the definition of "attached," unless otherwise specified herein.

Referring to the embodiment depicted in FIG. 1, the tubular 104 may also define first and second axial ends 110 and 112, which may be, for example, threaded box or pin connections. Further, the tubular 104 may be a segment of a casing string, drill string, or any other tubular or tubular string and may, in some instances, be configured to be made up to the other tubulars of the string and run into a wellbore.

In some cases, the tubular 104 may be free from upsets or other areas of increased radius to which a centralizer 102 may be secured; accordingly, in at least one example, one or more stop collars (two are shown: 106, 108) may generally restrict the axial and/or circumferential movement of the centralizer 102. The stop collars 106, 108 may be integral with or formed separately from the centralizer 102. Further, the stop collars 106, 108 may be held axially and circumferentially in place with respect to the tubular 104 using set screws, an interference fit or press fit, crimping, adhesives, or any other suitable process or device. Although two stop collars 106, 108 are depicted, it is expressly contemplated herein that a single stop collar 106 may be employed to restrict axial and/or circumferential movement of the centralizer 102 with respect to the tubular 104.

The centralizer 102 may be a bow-spring centralizer and may include two or more flexible ribs 114 that extend axially between end collars 115, 117. The flexible ribs 114 may define an initial outer diameter $OD_{C1}$ of the centralizer 102. The outer diameter $OD_{C1}$ may be variable, as the flexible ribs 114 may be configured to resiliently expand and collapse radially between a deployed configuration (shown) and a collapsed configuration, with the outer diameter being reduced in the collapsed configuration as compared to the outer diameter $OD_{C1}$ in the deployed configuration. Additionally, the stop collars 106, 108 may be disposed between the end collars 115, 117, such that, when fully collapsed, the flexible ribs 114 may engage the radial outside of the stop collars 106, 108.

The centralizer 102 may also define an axial length, which may vary according to the configuration of the ribs 114. In the illustrated, deployed configuration, the axial length is indicated as $L_{C1}$. When the centralizer 102 is collapsed, the axial length may increase, as the end collars 115, 117 slide apart to account for the reduced curvature of the ribs 114, for example, as will be described below with reference to FIG. 4.

Turning to the preconditioning and/or testing apparatus 100, the apparatus 100 generally includes a support fixture 116, a restrictor 118, and a driver 120. The support fixture 116 may engage or otherwise be attached with the axial end 110 of the tubular 104, so as to restrict relative movement between the tubular 104 and the support fixture 116 in at least one direction, e.g., a first axial direction $X_1$. Further, the support fixture 116 may be attached to the ground, or another reference plane, thereby fixing the position of the tubular 104 with respect thereto. The tubular 104 may additionally be supported by any suitable support structure.

In a specific embodiment, the support fixture 116 may include a plug 121 and a base 122. The plug 121 may be generally cylindrical and may extend from the base 122. Further, the plug 121 may be sized to be received into the axial end 110 of the tubular 104, for example, until the axial end 110 of the tubular 104 abuts the base 122. With the support fixture 116 secured to the ground (or another reference surface, such as the bed of a truck, a platform, etc.), the base 122 may bear on the axial end 110 of the tubular 104, such that the support fixture 116 may resist axial movement of the tubular 104 at least in the first axial direction $X_1$.

The base 122 may also include a cylindrical guard 123, which may fit over the exterior of the axial end 110 of the tubular 104. The axial end 110 may fit radially between the plug 121 and the guard 123. The guard 123 may serve to protect exterior threads from abrasion or other damage. Further, the support fixture 116 may be sized to fit over and/or around any thread protectors that may be positioned on the tubular 104. In at least one embodiment, the plug 121, the base 122, or at least a portion of either or both, may be made from a material that is soft relative to the tubular 104 and may protect the threads formed in or on the tubular 104, proximal to the axial end 110, from abrasion, deformation, or other modes of damage by interaction with the support fixture 116. For example, the material may be a polymer (e.g., nylon), elastomer, composite, or the like. In some embodiments, the support fixture 116 may fit over, and not mesh with, threads on the axial end 110 of the tubular 104, to avoid damage of the threads, for example, caused by cross-threading.

Figure 2:
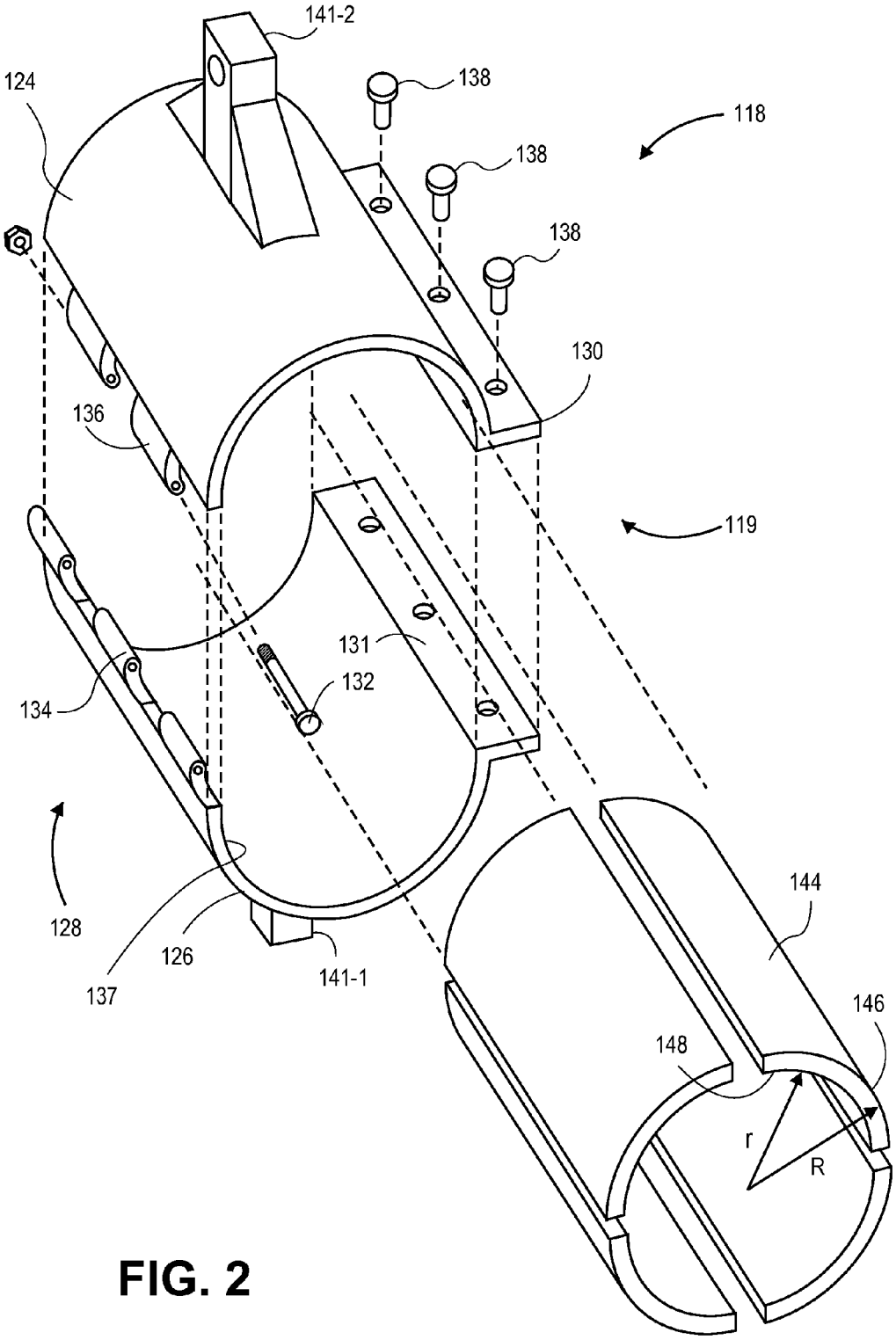
FIG. 2 illustrates a raised perspective view of a restrictor of the apparatus, according to an embodiment.

With continuing reference to FIG. 1, FIG. 2 illustrates a perspective, exploded view of the restrictor 118, according to an embodiment. The restrictor 118 may include a generally cylindrical structure 119. In some embodiments, the cylindrical structure 119 may be unitary and received over, for example, the axial end 112 of the tubular 104. In such an embodiment, the cylindrical structure 119 may be a segment of a tubular or pipe that is larger in diameter than the tubular 104. In the depicted embodiment, however, the restrictor 118 is configured as a clamp, such that the cylindrical structure 119 is formed as two arcuate segments 124, 126 that are pivotally attached together via a hinge assembly 128 and a closure mechanism, such as connecting flanges 130, 131. The use of pivotal arcuate segments 124, 126 may allow the restrictor 118 to be received on the middle of the tubular 104.

The hinge assembly 128 may include a hinge pin 132, which may be received through knuckles 134, 136 defined on the arcuate segments 124, 126 respectively. Further, the connecting flanges 130, 131 may be disposed circumferentially opposite to the hinge assembly 128 and may receive bolts 138 therethrough so as to fasten the two flanges 130, 131 together; however, in other embodiments, other fasteners, brackets, clamps, etc. may be employed to secure the connecting flanges 130, 131 together, e.g., face-to-face. In other embodiments, the connecting flanges 130, 131 may be omitted, with the arcuate segments 124, 126 held together via other devices and/or process (e.g., latches, crimping, flexible connection members, etc.). Further, in some embodiments, the hinge assembly 128 may be omitted, with the arcuate segments 124, 126 being secured together, e.g., via a second pair of mating connecting flanges or any other connecting assembly.

Additional segments and/or hinge assemblies may also be included, and one, some, or all the arcuate segments 124, 126 may not extend 180 degrees. For example, one of the arcuate segments 124, 126 may extend 200 or more degrees, while the other arcuate segment 124, 126 extends across a lesser angular span and serves as a door to receive the tubular 104 laterally into the cylindrical structure 119. In another embodiment, three arcuate segments may be provided, with one positioned vertically below the tubular 104, and the two others pivotally connected thereto and configured to close together at the top of the tubular 104, so as to provide a cradle for the tubular 104. It will be appreciated that the configurations of the restrictor 118 described are just a few among many contemplated.

The cylindrical structure 119 may define an inner diameter 137 that is larger than the outer diameter $OD_T$ of the tubular 104, such that the restrictor 118 is freely movable (translatable) along the tubular 104 in either axial direction $X_1$, $X_2$. As shown in FIG. 1, the restrictor 118 may also define an effective inner diameter $ID_R$, which may be the size of the inner-most radial surface thereof. In some cases, the inner diameter 137 may define the effective inner diameter $ID_R$. However, referring again to FIG. 2, in other cases, the restrictor 118 may include a set of shims 144 that reduce the effective inner diameter $ID_R$ when installed along at least a portion of the inner diameter 137.

In a specific embodiment, the shims 144 may each have an outer surface 146 that is curved to define a radius R that is approximately equal to the radius defining the curvature of the inner diameter 137 of the restrictor 118. An inner surface 148 of each shim 144 may define a smaller radius r. Accordingly, the shims 144 may be received and, e.g., fastened or otherwise retained in the inner diameter 137, such that the outer surface 146 interfaces with the inner diameter 137, thereby reducing the effective inner diameter $ID_R$. In some embodiments, the shims 144 may be received into the inner diameter 137 such that they extend circumferentially along all or substantially all of the inner diameter 137; however, in other embodiments, spaces or gaps may be defined between circumferentially-adjacent shims 144. Such gaps may be uniform or may differ among the pairs of adjacent shims 144. In at least one embodiment, the gap may be formed by receiving fewer than the number of shims 144 required to form a cylinder (e.g., using three of the four illustrated shims 144).

Additionally, several sets of shims 144 of varying sizes may be provided, so as to allow a selection from a range of effective inner diameters $ID_R$ for the restrictor 118. Further, the shims 144 may be secured to the cylindrical structure 119 of the restrictor 118 via recesses, grooves, press fitting, fasteners, clamps, adhesives, or any other device and/or process. In some cases, multiple shims 144 may be stacked together to further reduce the effective inner diameter $ID_R$.

Although illustrated as maintaining a generally constant curvature along their axial extents, either or both of the shims 144 and/or the inner diameter 137 of the cylindrical structure 119 may have varying profiles. For example, one or both of the shims 144 and the inner diameter 137 may define a tapered radially-inner surface, such that the effective inner diameter $ID_R$ may progressively decrease from one axial end to the other. In other embodiments, other geometries for the shims 144 and/or the inner diameter 137, such as stepped profiles, curved profiles, etc. may be employed, such that the effective inner diameter $ID_R$ may vary for a single restrictor 118.

Turning again to FIG. 1, the restrictor 118 has a weight that may, in some embodiments, not be supported by the ground, but may ride on the tubular 104 and eventually on the centralizer 102. The weight applied by the restrictor 118 may affect the starting and/or running forces of the centralizer 102 and may represent a deviation from actual wellbore conditions. Accordingly, in at least one embodiment, the restrictor 118 may be fabricated from a light-weight material, so as to minimize deviations from wellbore conditions. Such materials may include, for example, aluminum alloys, although other metals, alloys, composites, etc. are contemplated for use. In other embodiments, as will be described below, the weight of the restrictor 118 may be supported by the tubular 104, the ground, or any other structure that is not the centralizer 102, and thus the weight of the restrictor 118 may not be borne by the centralizer 102. In such embodiments, a variety of other, heavier materials, e.g., steel, may be used for the restrictor 118. In some cases, however, the weight of the restrictor 118, even with heavier materials, may be considered a negligible deviation from wellbore conditions, and thus any material may be used, with or without external support.

The restrictor 118 may define a length $L_R$ along its axial extent. The length $L_R$ may be greater than, equal to, or smaller than the axial length $L_{C1}$ of the centralizer 102 in the illustrated, deployed configuration. The length $L_R$ of the restrictor 118 may be selected, for example, to simulate known or expected wellbore conditions. In other embodiments, one restrictor 118 may be employed for several different types of centralizers 102, which may have different lengths $L_{C1}$, some of which are larger, smaller, or equal to the length $L_R$ of the restrictor 118.

The restrictor 118 may also include or be attached to ears 141-1, 141-2 extending outwards from the cylindrical structure 119, e.g., one on each arcuate segment 124, 126. The ears 141-1, 141-2 may be attached to flexible connection members 143, 145 and may, for example, allow the flexible connection members 143, 145 to extend radially outside of the centralizer 102, so as to avoid the flexible connection members 143, 145 engaging the ribs 114. The flexible connection members 143, 145 may be cables, ropes, chains, belts, braided wires, or the like. In other embodiments, the flexible connection members 143, 145 may be attached to the restrictor 118 via hooks, holes, etc. of the cylindrical structure 119, such that the restrictor 118 may omit the ears 141-1, 141-2, and the flexible connection members 143, 145 may extend between circumferentially-adjacent ribs 114. Further, the flexible connection members 143, 145 may be attached to the driver 120, such that the driver 120 is attached to the restrictor 118 via the flexible connection members 143, 145. Although two flexible connection members 143, 145 are shown, it will be appreciated that more or fewer flexible connection members may be employed.

The driver 120 may include one or more winches (two shown: 139, 140) and a prime mover 142, such as an electric motor, gas or diesel engine, wind or air, etc. configured to drive the winches 139, 140. In at least one embodiment, the winches 139, 140 and/or the prime mover 142 may be attached to the support fixture 116, e.g., mounted thereto such that the two are not relatively movable. In other examples, the winches 139, 140 may be secured directly to the tubular 104, or to another surface that is stationary with respect to the tubular 104. In still other embodiments, however, the winches 139, 140 may be omitted, for example, and the flexible connection members 143, 145 secured to a structure that is movable with respect to the tubular 104 (e.g., a vehicle). It will be appreciated that a variety of configurations of the winches 139, 140, support fixture 116, the prime mover 142, and the tubular 104 may be employed.

The winches 139, 140 may be configured to draw in the flexible connection members 143, 145, respectively, thereby transmitting axially-directed force to the restrictor 118 and causing the restrictor 118 to axially translate along the tubular 104 in the first axial direction $X_1$. Further, the driver 120 may include a load cell 147, which may be, for example, an ammeter, strain gauge, weight gauge or sensor, etc. configured to provide measurements indicative of the force applied by the driver 120 on the restrictor 118. The load cell 147 may be attached to a computer, a display, and/or a logging device, so as to translate and/or record measurements taken while operating the apparatus 100.

Figure 3:
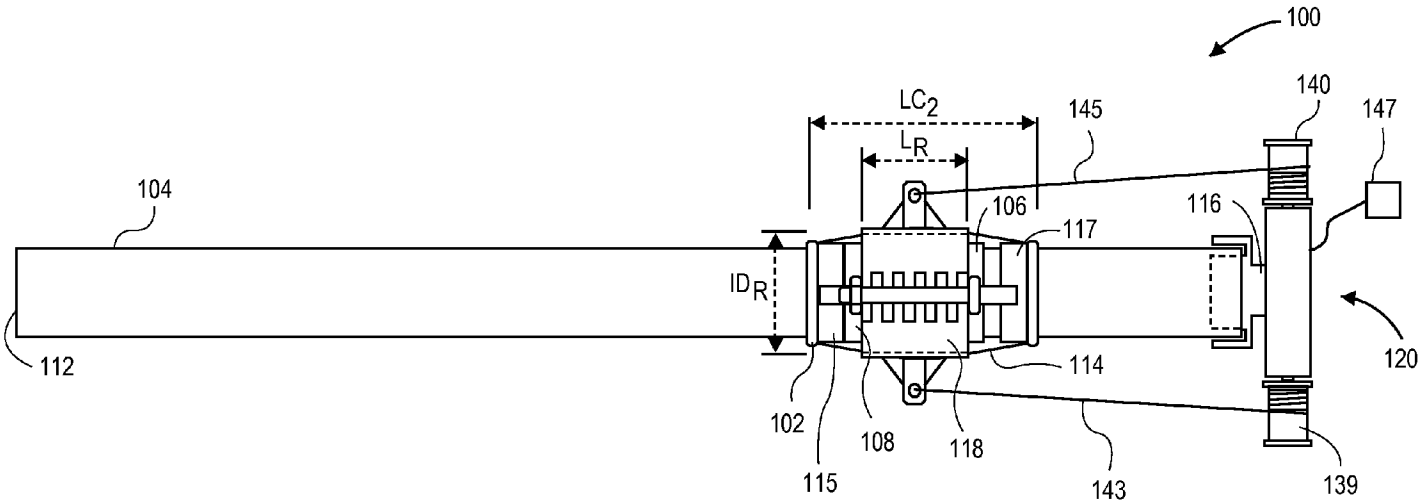
FIG. 3 illustrates a side schematic view of the apparatus, depicting an intermediate configuration thereof, according to an embodiment.
Figure 4:
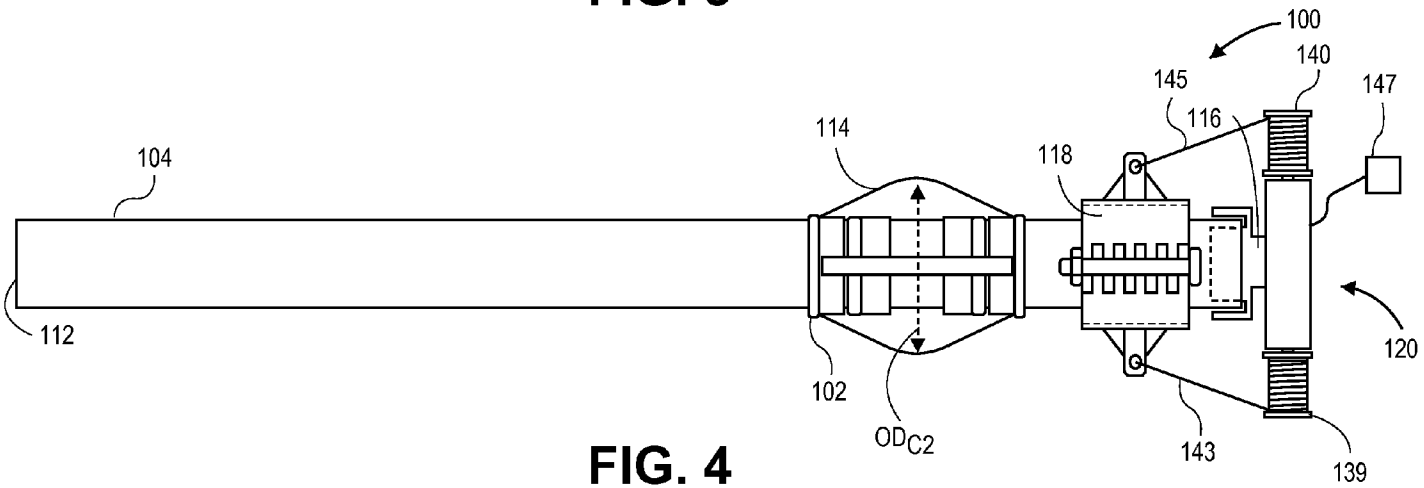
FIG. 4 illustrates a side schematic view of the apparatus, depicting a phase-complete configuration thereof, according to an embodiment.

Turning now to operation of the apparatus 100, the configuration illustrated in FIG. 1 may be an initial configuration, with the restrictor 118 positioned axially adjacent to the centralizer 102, and the centralizer 102 being axially between the restrictor 118 and the support fixture 116. FIGS. 3 and 4 illustrate side schematic views of the apparatus 100 in an intermediate configuration and a phase-complete configuration, respectively, illustrating one example of a progression of the restrictor 118.

Beginning with FIG. 1, the restrictor 118 may be advanced in the first axial direction $X_1$, toward the centralizer 102 by the winches 139, 140 turning and drawing in the flexible connection members 143, 145. As shown in FIG. 2, the restrictor 118 may be pulled over and at least partially across the centralizer 102. In an embodiment, the rate of axial movement of the restrictor 118 may be between about 0.01 ft/s (0.003 m/s) and about 1 ft/s (0.3 m/s), for example, about 0.1 ft/s (0.03 m/s).

The effective inner diameter $ID_R$ of the restrictor 118 may be less than the deployed diameter $OD_{C1}$ of the centralizer 102. Accordingly, as shown in FIG. 2, the advancing restrictor 118 collapses the flexible ribs 114 of the centralizer 102 as the restrictor 118 is moved (e.g., pulled) across the centralizer 102. As the centralizer 102 is collapsed, thereby reducing its outer diameter $OD_{C1}$ from the deployed outer diameter (FIG. 1) to substantially the effective inner diameter $IR_R$ of the restrictor 118, the length of the centralizer 102 may increase from the initial axial length $L_{C1}$ to a collapsed axial length $L_{C2}$. For example, by the end collars 115, 117 may translate axially apart along the tubular 104 as the ribs 114 collapse. Further, the end collar 115 may engage the stop collar 108, so as to prevent continued axial translation of the centralizer 102 with the restrictor 118. Accordingly, the centralizer 102 may begin collapsing under the force of the restrictor 118, apply a starting force to the restrictor 118 when the restrictor 118 first encounters the ribs 114 of the centralizer 102, and apply a running force to the restrictor 118 as the restrictor 118 moves along the ribs 114.

Further, the effective inner diameter $ID_R$ of the restrictor 118 may be selected such that it collapses the ribs 114 to a degree expected in the wellbore. For example, one or more of the shims 144 may be inserted into the restrictor 118 to vary the effective inner diameter $ID_R$, when appropriate. In some cases, e.g., close tolerance applications, the restrictor 118 may fully collapse the ribs 114 toward the tubular 104. The full collapse of the ribs 114 may cause the ribs 114 to abut against the radial outside of the stop collars 106, 108. Accordingly, in an embodiment, the apparatus 100 may simulate actual collapse of the installed centralizer 102 against the tubular 104 and/or the stop collars 106, 108 in wellbore conditions. Further, the stop collars 106, 108 being in position to provide an end range for axial movement of the centralizer 102 may allow for testing of the stop collar 106, 108 holding force, in addition to testing and/or preconditioning the centralizer 102.

In embodiments where the length $L_R$ of the restrictor 118 is greater than or equal to the length $L_C$ of the centralizer 102, the advancing restrictor 118 may collapse the ribs 114 along the entire axial extent thereof, which may provide a full and accurate measurement of the running force applied by the centralizer 102. In other embodiments, the restrictor 118 may be axially shorter than the centralizer 102 and thus may progressively collapse portions of the ribs 114.

As the restrictor 118 continues to advance by operation of the driver 120, the restrictor 118 may be pulled from engagement with the centralizer 102, as shown in FIG. 4, e.g., by the winches 139, 140 pulling and receiving the flexible connection members 143, 145. This may end a phase of the preconditioning process, and thus the configuration shown may be referred to as "phase-complete." However, in other embodiments, the phase-complete configuration may be that shown in FIG. 3, or any point between the configuration shown in FIG. 1 and that shown in FIG. 3 or FIG. 4, for example, depending on the expected or known characteristics of the wellbore or any other factor.

Once having reached the phase-complete configuration, in some cases, the testing and preconditioning may be complete. Without being bound by theory, the first pass of the restrictor 118 over the centralizer 102 may yield the ribs 114 of the centralizer 102, such that minimal subsequent yield in the wellbore is expected. Such yielding may plastically deform the ribs 114, such that the centralizer 102 may have a smaller outer diameter $OD_{C2}$ after contact with the restrictor 118, as will be explained in greater detail below.

Further, after engagement with the restrictor 118, for example, the centralizer 102 may be inspected, e.g., using a magnetic particle inspection (MPI) and/or other tests, to determine if cracks have developed or the integrity of the centralizer 102 has been compromised in any other way. Subsequent collapsing of the centralizer 102 on the tubular 104 deployed into the wellbore may not be expected to further significantly yield the ribs 114, unless the effective inner diameter $ID_R$ is reduced. Accordingly, employing the apparatus 100 may allow for an accurate test of performance and may provide a high-level of confidence in the structural integrity of the centralizer 102 in the wellbore. This yielding may also reduce the starting and running forces of the centralizer 102, thereby facilitating deployment of the tubular 104 and centralizer 102 into the wellbore.

In some cases, however, additional testing/preconditioning may be employed. As such, the process of FIGS. 1, 3, and 4 may be repeated, either proceeding in the same axial direction $X_1$ or in the reverse axial direction $X_2$. For example, the support fixture 116 and/or the driver 120 may be removed and may be disposed on the other axial end 112 of the tubular 104, and operated to pull the restrictor 118 back across the centralizer 102 in a second axial direction $X_2$, Opposite to the first axial direction $X_1$. In another example, the restrictor 118 may be removed, the flexible connection members 143, 145 extended, and the restrictor 118 placed back around the tubular 104 in the position shown in FIG. 1. The restrictor 118 may then be pulled again across the centralizer 102 in the process described above.

Passing the restrictor 118 across the centralizer 102 a second time (or any number of additional times) may, for example, allow for sequentially smaller effective inner diameters $ID_R$ to be employed, so as to more gently yield the ribs 114 over a plurality of passes. In other embodiments, the effective outer diameter $ID_R$ may not be reduced for one or some of the subsequent passes. Since substantially all of the yielding may take place by the first pass (or whichever pass applies the smallest effective inner diameter $ID_R$), subsequent passes of the restrictor 118 across the centralizer 102, without reducing the effective inner diameter $ID_R$, may provide accurate and repeatable measurements of starting, running, and/or restoring forces applied by the centralizer 102.

During any translation of the restrictor 118, the load cell 147 may take measurements of the forces applied by the driver 120 on the centralizer 102, on the particular tubular 104 on which the centralizer 102 is to be run into the wellbore, for example. This may provide additional data to operators running the tubular 104 into the wellbore, which may assist, for example, in determining the force required to advance the tube string into the wellbore and/or determine where in the string the particular tubular 104 with the known centralizer 102 characteristics should be positioned.

In some instances, the ribs 114 of the centralizer 102 may be deformed from an original shape to a deformed geometry by yielding the ribs 114, using the apparatus 100. As such, the outer diameter of the centralizer 102 may be reduced from the initial outer diameter $OD_{C1}$ to a preconditioned outer diameter $OD_{C2}$, after preconditioning. The preconditioned outer diameter $OD_{C2}$ may be smaller than the initial outer diameter $OD_{C1}$ by any amount, e.g., a fraction (e.g., about $1/8^{th}$) of an inch or less.

However, this preconditioned outer diameter $OD_{C1}$ may be measurable, for example, using a go/no-go gauge. If the starting and/or running forces are high, a go/no-go gauge of a certain diameter may indicate a "no-go" if above a predetermined threshold amount of force is needed to move the gauge axially across the centralizer 102. This may be indicative of the centralizer 102 not having been preconditioned. On the other hand, the go/no-go gauge may indicate a "go" when the starting or running forces are lower than the predetermined amount, which may be caused by preconditioning the ribs 114 of the centralizer 102, as described above. In some cases, the restrictor 118 itself may provide the go/no-go gauge or a sleeve, etc., may be provided as the gauge. Further, the load cell 147 may record the force, which may be used to register a go/no-go determination according to whether the force required to move the gauge (e.g., restrictor 118) is above a certain threshold.

Figure 5:
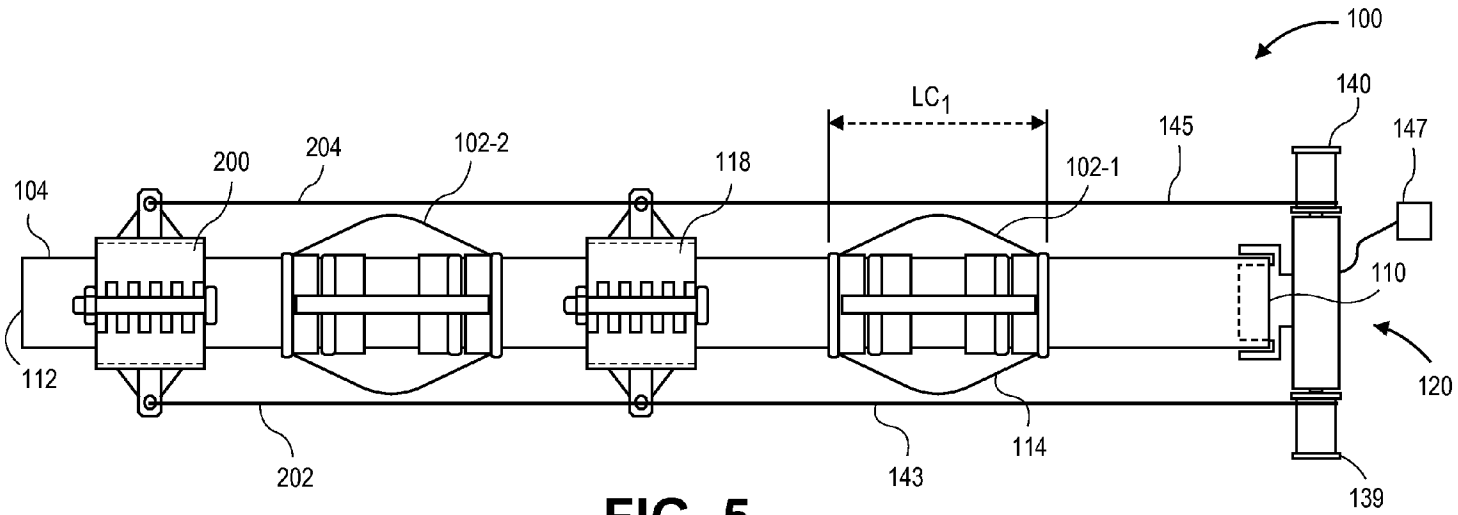
FIG. 5 illustrates a side schematic view of the apparatus including two restrictors, according to an embodiment.

FIG. 5 illustrates a side schematic view of the apparatus 100, according to another embodiment. In some applications, multiple centralizers 102 (two shown: 102-1 and 102-2) may be disposed on the tubular 104. In some cases, a single restrictor 118 may be employed to collapse the centralizers 102-1, 102-2 in sequence, one at a time. However, in some cases, it may be advantageous to precondition and/or test the multiple centralizers 102-1, 102-2 substantially simultaneously.

Accordingly, as shown, the apparatus 100 may include a second restrictor 200, which may be axially separated from the first restrictor 118, such that the centralizer 102-2 is positioned therebetween in at least one configuration. The second restrictor 200 may be, for example, substantially similar in structure and function to the restrictor 118. Further, the two restrictors 118, 200 may have the same or different dimensions (e.g., length $L_R$, effective inner diameter $ID_R$, etc.), as desired. Further, the second restrictor 200 may be attached to the restrictor 118 via flexible connection members 202, 204 or may be attached directly to the driver 120 (e.g., via the same or different winches 139, 140), such that the two restrictors 118, 200 are movable in tandem to collapse the centralizers 102-1, 102-2, as described above with respect to FIGS. 1, 3, and 4. Thus, the load cell 147 may measure the combined running and/or starting forces of the centralizers 102-1 and 102-2.

Figure 6:
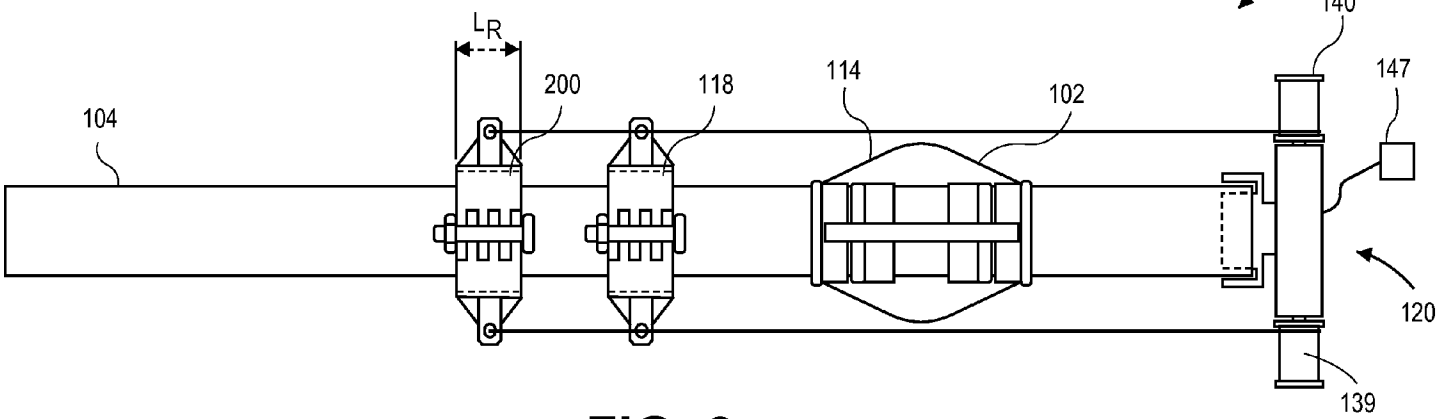
FIG. 6 illustrates a side schematic view of another embodiment of the apparatus including two restrictors.

FIG. 6 illustrates a side schematic view of the apparatus 100, according to another embodiment. The embodiment of the apparatus 100 shown includes the second restrictor 200, along with the restrictor 118. In this case, however, the use of two restrictors 118, 200 may simulate a dual restriction in the wellbore. Thus, operation of the apparatus 100 may result in the measurement of data for successive compressions or collapsing of the centralizer 102.

Further, in some cases, the axial spacing or separation between the restrictors 118, 200 may be less than the initial length $L_{C1}$ of the centralizer 102, the collapsed length $L_{C2}$ (FIG. 4) of the centralizer 102, or both. As such, collapsing the centralizer 102 using the restrictor 118 may overlap, chronologically, with collapsing the centralizer 102 using the second restrictor 200, i.e., both restrictors 118, 200 may engage the ribs 114 at the same time but at different axial locations. Further, in some embodiments, the length $L_R$ of the restrictors 118, 200 may be reduced, as compared to the restrictor 118 of the embodiments of FIGS. 1 and 3-5. It will be appreciated, however, that the restrictors 118, 200 may have any suitable and/or different lengths $L_R$.

In some embodiments, the effective inner diameter $ID_R$ (e.g., FIG. 1) of the restrictor 200 may be smaller than that of the restrictor 118. Accordingly, the centralizer 102 may be compressed or collapsed stepwise, with the second restrictor 200 collapsing the centralizer 102 to a greater degree than does the restrictor 118, or vice versa.

Figure 7:
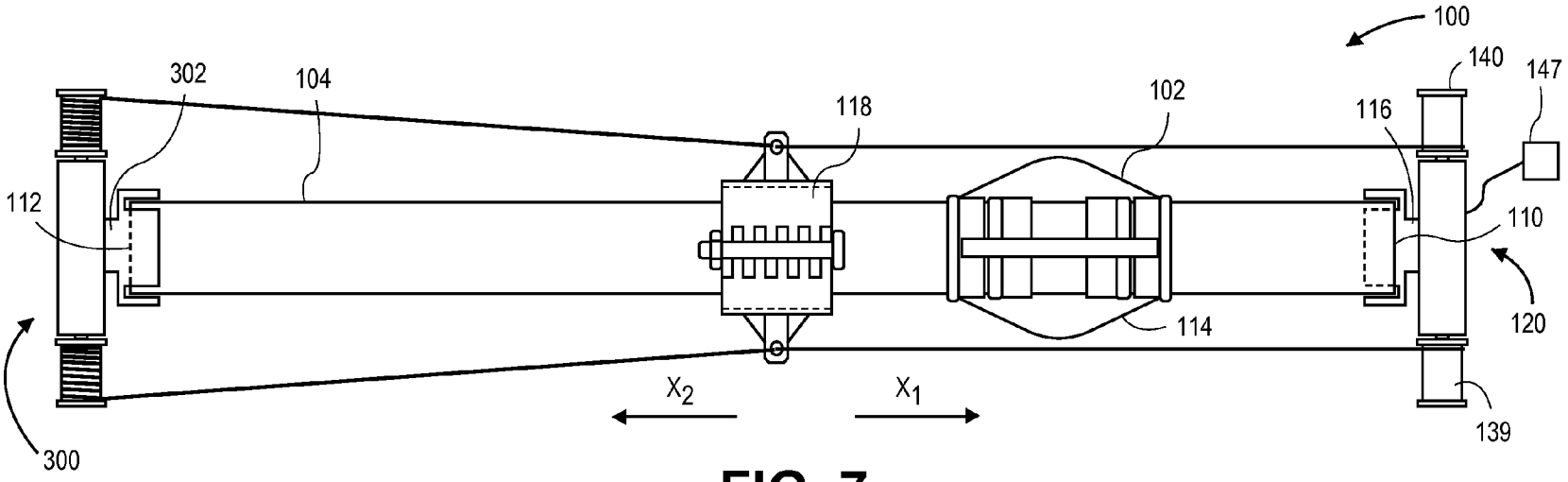
FIG. 7 illustrates a side schematic view of the apparatus including two drivers, according to an embodiment.

FIG. 7 illustrates a side schematic view of the apparatus 100, according to another embodiment. The embodiment shown in FIG. 7 may additionally include a second driver 300 and a second support fixture 302 that are configured to pull the restrictor 118 in the second axial direction $X_2$. The second driver 300 and the second support fixture 302 may be substantially similar in structure and operation to the driver 120 and support fixture 116, respectively. However, the second driver 300 and/or second support fixture 302 may be attached to the axial end 112 of the tubular 104, opposite to the axial end 110 to which the driver 120 and the support fixture 116 may be secured. For example, after reaching a phase-complete configuration using the driver 120 and the support fixture 116, e.g., with the restrictor 118 having been pulled at least partially axially across the centralizer 102 in the first axial direction $X_1$, the restrictor 118 may be pulled in the second axial direction $X_2$, back across the centralizer 102, using the second driver 300 and the second support fixture 302.

Figure 8:
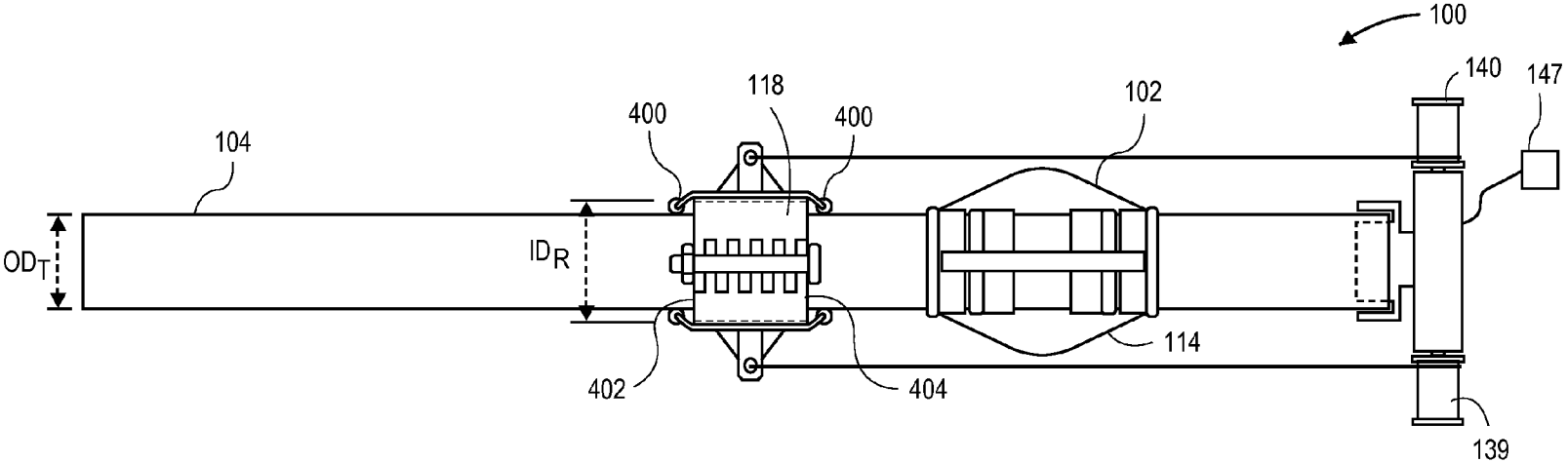
FIG. 8 illustrates a side schematic view of the apparatus including rollers on the restrictor, according to an embodiment.

FIG. 8 illustrates a side schematic view of the apparatus 100, according to another embodiment. As noted above, it may be desirable to avoid a lateral (e.g., downward in the Figure) force, generated by the weight of the restrictor 118 itself. Thus, the restrictor 118 may include one or more rollers 400, for example, extending axially and radially from the axial ends 402, 404. In some embodiments, the rollers 400 may extend only from one of the axial ends 402, 404, for example, the trailing axial end 402, such that the rollers 400 may avoid engagement with the centralizer 102. In another embodiment, the rollers 400 may extend from the leading axial end 404, such that the rollers 400 proceed circumferentially in between the ribs 114.

The rollers 400 may include springs, shock absorbers, bearings, dampers, etc., such that the rollers 400 may be positioned (e.g., adjustably) to ride smoothly along the tubular 104, while maintaining the restrictor 118 in a generally concentric position with the tubular 104. In another embodiment, the rollers 400 may be substituted with, for example, low-friction pads that slide across the surface of the tubular 104. Using the rollers 400 (and/or pads), the weight of the restrictor 118 may be transferred to the tubular 104, such that the weight does not affect the compression of the centralizer 102. Further, in at least one embodiment, the rollers 400 may form part of the driver 120 and may be motorized so as to move the restrictor 118 across the centralizer 102, e.g., in addition to or in lieu of the flexible connection members 143, 145 and winches 139, 140.

Figure 9:
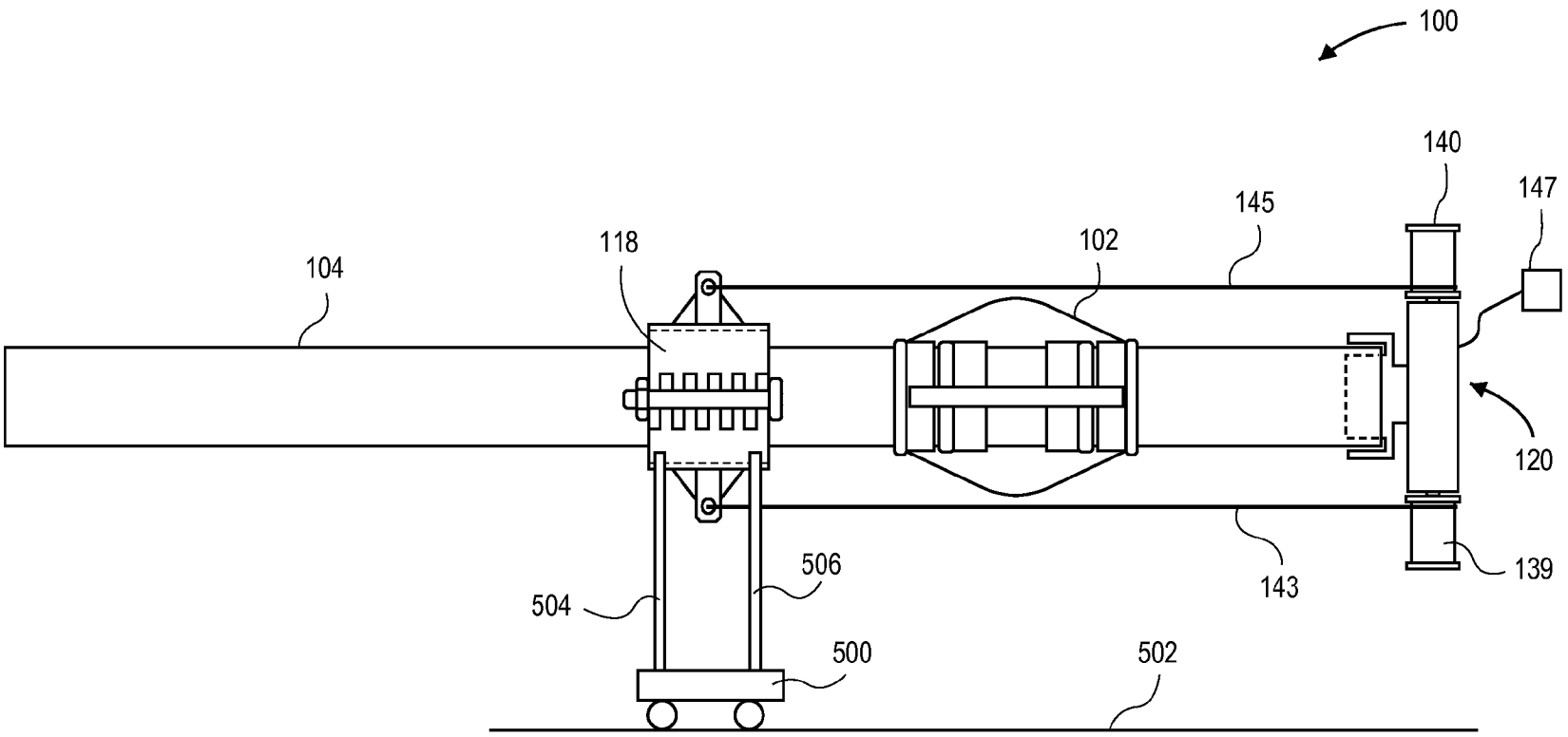
FIG. 9 illustrates a side schematic view of the apparatus including a cart supporting the restrictor, according to an embodiment.

FIG. 9 illustrates an embodiment of the apparatus 100 that includes a cart 500 configured to roll, slide, or otherwise move along a surface, such as a track 502. The cart 500 may be attached to the restrictor 118 via one or more braces 504, 506. Accordingly, the cart 500 and the braces 504, 506 may be configured to transfer the weight of the restrictor 118 to the track or surface 502, while allowing the restrictor 118 to translate axially, such that the weight of the restrictor 118 does not affect the collapsing of the centralizer 102. In some embodiments, the height of the braces 504. 506 and/or the cart 500, and/or the horizontal position of the track 502 may be adjustable so as to maintain the restrictor 118 in generally concentric position with the tubular 104.

As shown, the driver 120 may act on the restrictor 118 via the flexible connection members 143, 145, with the cart 500 being pulled along with the restrictor 118. However, in other embodiments, the driver 120 may be part of the cart 500. For example, the cart 500 may be motorized so as to provide the force that axially translates the restrictor 118. In another embodiment, one or more of the flexible connection members 143, 145 may be attached to the cart 500, such that the driver 120 acts directly on the cart 500, which in turn moves the restrictor 118. Further, it will be appreciated that the cart 500 may be vertically above the restrictor 118 in some embodiments, and, for example, suspended from the track 502.

Figure 10:
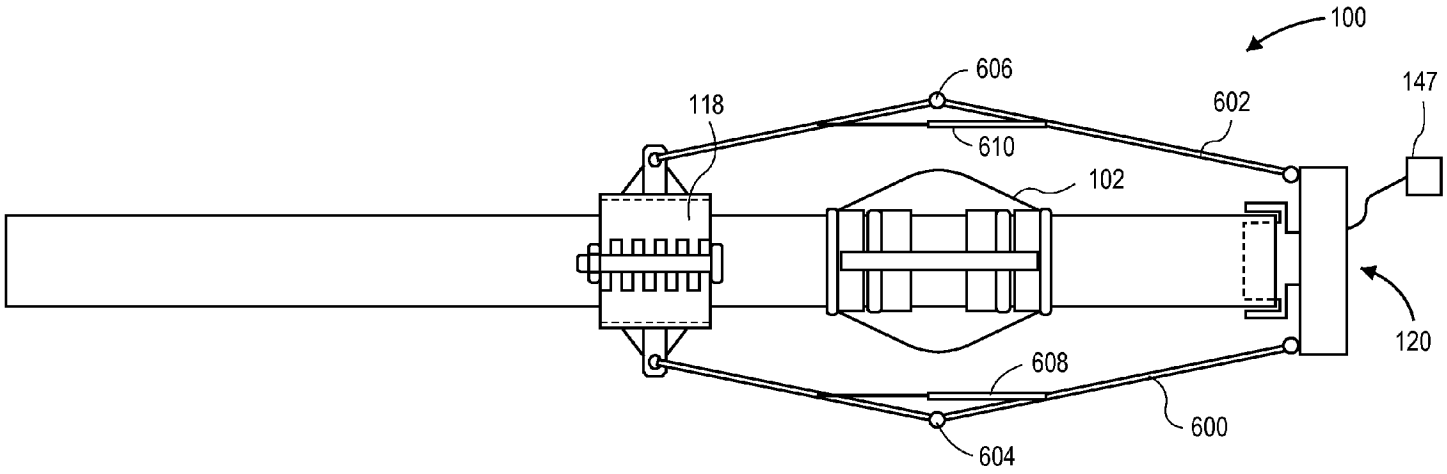
FIG. 10 illustrates a side schematic view of the apparatus including hydraulic arms, according to an embodiment.
Figure 11:
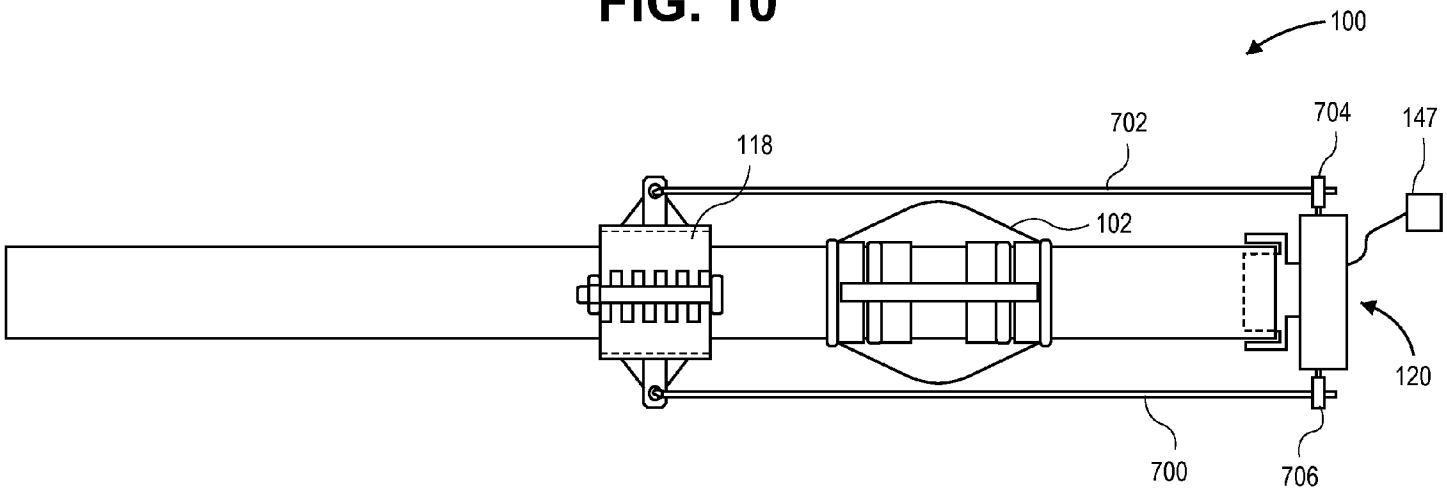
FIG. 11 illustrates a side schematic view of the apparatus including a screw-drive, according to an embodiment.

FIGS. 10 and 11 each illustrate a side schematic view of another embodiment of the apparatus 100. In FIG. 10, the driver 120 of the apparatus 100 may include hydraulic arms 600, 602. The hydraulic arms 600, 602 may pivot around a joint 604, 606, respectively, or may extend and retract linearly. The driver 120 may further include hydraulic cylinders 608, 610 to effect such pivoting of the arms 600, 602 about the joint 604, 606. In other embodiments, the hydraulic cylinders 608, 610 may provide at least a portion of the arms 600, 602, such that the arms 600, 602 are linearly extendable by operation of the hydraulic cylinders 608, 610. In such hydraulic embodiments, the driver 120 may be bi-directional, and thus capable of pushing and pulling the restrictor 118 across the centralizer 102. Accordingly, the support fixture 116 and/or other support structures may be configured to resist axial motion of the tubular 104 with respect thereto in both axial directions $X_1$, $X_2$.

In FIG. 11, the driver 120 is a screw-drive assembly. Accordingly, the driver 120 may include one or more threaded rods (two shown: 700, 702) and one or more nuts (two shown: 704, 706). In an embodiment, the nuts 704, 706 may be attached to the support fixture 116 or to another surface that is stationary with respect to the tubular 104 so as to move the restrictor 118 with respect thereto. Accordingly, the driver 120 may rotate the rods 700, 702, the nuts 704, 706, or both, so as to advance the threaded rods 700, 702 through the nuts 704, 706, respectively. Further, in the bi-directional driver 120 embodiments of FIGS. 10 and 11, the tubular 104 may be supported and, for example, restrained from axial movement by the support fixture 116 and/or any other suitable supporting structures.

Figure 12:
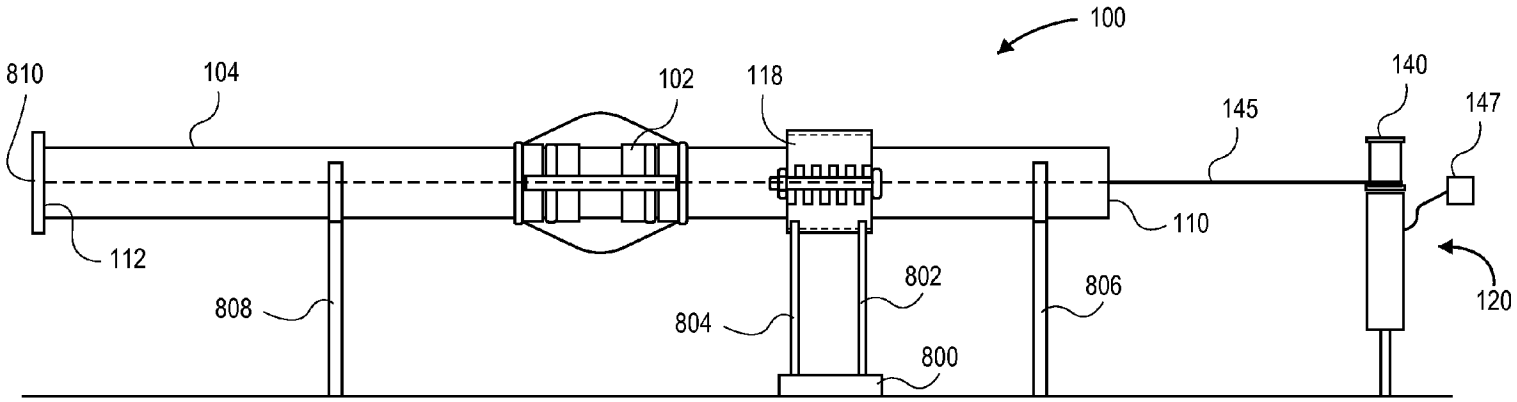
FIG. 12 illustrates a side schematic view of the apparatus in which the tubular is driven by the driver, according to an embodiment.

FIG. 12 illustrates another embodiment of the apparatus 100, for example, in an initial configuration prior to the restrictor 118 engaging the centralizer 102. As shown, the driver 120 may be spaced apart from the axial end 110 of the tubular 104. In lieu of (or, potentially in addition to) the base 122 and plug 121, the apparatus 100 may include a base 800, one or more restrictor supports (two shown: 802, 804), one or more tube supports (two shown: 806, 808). The restrictor supports 802, 804 may extend between and be attached to the restrictor 118 and the ground or another relatively stationary surface, such that the supports 802, 804 support the weight of the restrictor 118, e.g., maintaining it generally concentric to the tubular 104. The supports 802, 804 may restrain the restrictor 118 from moving with to the supports 802, 804. In turn, the restrictor supports 802, 804 may be attached to the ground or another surface that is stationary relative to the tubular 104, for example, via the base 800, but in other embodiments, may be attached directly to the ground or other stationary reference surface. Accordingly, the restrictor supports 802, 804 may maintain a stationary position of the restrictor 118, with respect to the ground.

The tubular supports 806, 808 may support a weight of the tubular 104, and may allow axial movement of the tubular 104 with respect thereto. Accordingly, the tubular supports 806, 808 may include rollers, wheels, low-friction surfaces, etc., as desired to facilitate movement of the tubular 104 with respect thereto. In some cases, the tubular supports 806, 808 may be received around the tubular 104, but in others may be open, e.g., at the top, so as to facilitate loading of the tubular 104. In another embodiment, the tubular supports 806, 808 may be positionally fixed to the tubular 104, and movable with respect to the ground (e.g., via wheels, sleds, etc.).

The apparatus 100 may also include an end plate 810, which may be coupled with the winch 140 of the driver 120 via the flexible connection member 145. The end plate 810 may be sized having a diameter (or another dimension, such as a diagonal, length, width, height, etc.) that is at least greater than a nominal inner diameter of the tubular 104. As such, the end plate 810 may be prevented from sliding through the axial end 112 and into the tubular 104. In an embodiment, the flexible connection member 145 may extend through the open axial end 110 of the tubular 104, so as to connect to the end plate 810 within the tubular 104; however, in other embodiments, the flexible connection member 145 (and/or 143, as shown in FIG. 1) may extend outside of the tubular and connect with the end plate 810, for example, via ears attached to or integrally formed with the end plate 810.

Figure 13:
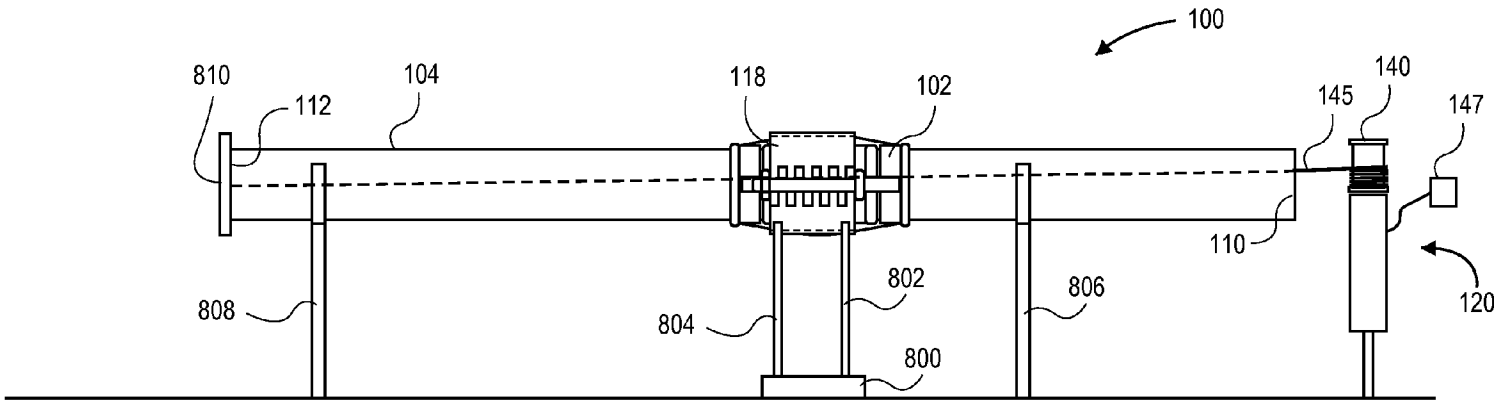
FIG. 13 illustrates a side schematic view of the apparatus shown in FIG. 12 with the tubular having been driven by the driver, according to an embodiment.

FIG. 13 illustrates a schematic side view of the embodiment of the apparatus 100 of FIG. 12, in a second configuration, with the centralizer 102 collapsed by the restrictor 118. With reference to both FIGS. 12 and 13, as can be appreciated by the changed position of the tubular 104 in FIGS. 12 and 13, the tubular 104 may be driven to move relative to the restrictor 118 (and the stationary surface/ground) via operation of the drive 120. For example, the winch 140 may draw in the flexible connection member 145, exerting an axially-directed force on the end plate 810. The end plate 810, being too large to be received through the tubular 104, may transmit this axial force onto the second axial end 112 of the tubular 104. In response to the force on the second axial end 112, the tubular 104, supported by the tubular supports 806, 808 and axially movable with respect to the ground, may be moved in the first axial direction $X_1$ by operation of the driver 120. As the tubular 104 is moved relative to ground, and the restrictor 118 is restrained from movement, the restrictor 118 may be drawn across at least a portion of the centralizer 102, thereby collapsing the centralizer 102, as described above. In various embodiments, the restrictor 118 may be drawn partially or entirely across the centralizer 102, and may be drawn at least partially across the centralizer 102 once or multiple times, in either axial direction $X_1$, $X_2$, as described above. Further, multiple restrictors 118 may be employed.

Figure 14:
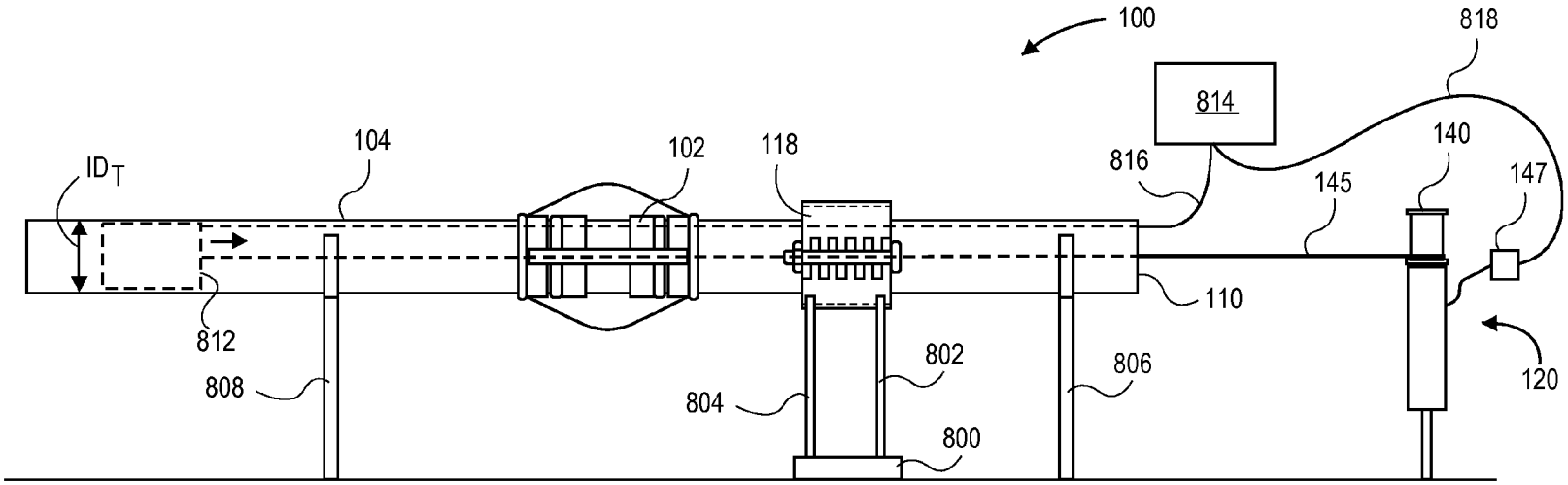
FIG. 14 illustrates a side schematic view of the apparatus including a measuring device, according to an embodiment.

FIG. 14 illustrates a side schematic view of the apparatus 100, according to another embodiment. The apparatus 100 may include a measuring device 812, which may be coupled with a computing device 814, which may be a special or general purpose computer of any suitable type and may or may not include peripherals such as a display, keyboard, mouse, etc. The computing device 814 may be coupled with the measuring device 812 via a signal transmission line 816, or may be wirelessly coupled thereto. Similarly, the computing device 814 may be coupled with the load cell 147 via a signal transmission line 818 or wirelessly. In another embodiment, separate computing devices may be provided for receiving data from each of the load cell 147 and the measuring device 812 independently. In other embodiments, either or both of the measuring device 812 and/or the load cell 147 may not be coupled with a computing device, and thus the computing device 814 may be omitted. Further, it will be appreciated that the computing device 814 may be coupled with the load cell 147 in any of the other embodiments of the apparatus 100 and may be used to collect and/or analyze data from the load cell 147 during operation thereof.

In an embodiment, the measuring device 812 may be a drift. A drift may be a device configured to measuring the cylindricity of an inner diameter $ID_T$ of the tubular 104. The drift may be sized, for example, to simulate a downhole tool of any type that may be potentially run through the tubular 104. Accordingly, the measuring device 812 may have an outer diameter that is slightly less than the inner diameter $ID_T$ of the tubular 104. Further, in an embodiment, the measuring device 812 may have an axial length of, for example, about 12 inches (about 0.30 meters). In other embodiments, the measuring device 812 may have any other axial length.

In another embodiment, the measuring device 812 may be an ultrasonic probe, configured to measure an inner diameter of the tubular 104 along one or more diametral lines (i.e., at a plurality of angles). In at least one embodiment, the measuring device 812 may be both a drift and an ultrasonic probe or may be any other device that may be drawn through the tubular 104 prior to running the tubular 104 into the wellbore, for example.

The measuring device 812 may be coupled with the driver 120, for example, via the flexible connection member 145 extending through the tubular 104 and received by the winch 140. Accordingly, the driver 120 may turn the winch 140, drawing in the flexible connection member 145 and moving the measuring device 812 through the tubular 104. Where applicable, any signals generated by the measuring device 812 may be transmitted to the computing device 814. For example, the wall thickness of the tubular 104 may be measured, and added to a measurement of the inner diameter $ID_T$ taken by the measuring device 812 to yield a precise mapping of the outer diameter of the tubular 104

Further, the force required to move the measuring device 812 through the tubular 104 may be measured by the load cell 147 and recorded by the computing device 814. Accordingly, in the case where the measuring device 812 includes a drift, any areas departing from the expected cylindricity may be indicated by increases in force required to draw the measuring device 812 through the tubular 104. Areas of reduced cylindricity may be located, for example, where the stop collars 106, 108 are received onto the tubular 104, e.g., via crimping.

Although illustrated for use with an embodiment in which the tubular 104 is driven by the driver 120, it will be appreciated that the apparatus 100 may be configured such that the measuring device 812 is used in the embodiment of FIG. 1, in which the restrictor 118 is driven by the driver 120. Such an embodiment may include removing the base 122 and plug 121, e.g., after preconditioning, and extending the flexible connection member 145 through the tubular 104. In another embodiment, a third winch may be provided, with a flexible connection member extending through the tubular 102 e.g., past and/or through the prime mover 142 and/or support fixture 116. In another embodiment, the measuring device 812 may have a driver therein, such that, for example, the measuring device 812 translates along the flexible connection member 145 independently of the driver 120. Accordingly, the measuring device 812 may translate at the same time that the tubular 104 or the restrictor 118 is driven. It will be appreciated that a variety of configurations of the apparatus 100 including the measuring device 812 are contemplated and may be employed without departing from the scope of the present disclosure.

Further, it will be appreciated that elements of the various embodiments of the apparatus 100 may be combined and are not to be considered mutually exclusive, unless otherwise expressly stated herein. Accordingly, any combination of multiple restrictors, multiple drivers, bi-directional drivers, carts, rollers, etc., as described herein, may be employed consistent with embodiments of the apparatus 100. Further, the apparatus 100 and tubular 104 need not be disposed horizontally, but may be disposed in any position with respect to the ground, including being hoisted vertically. Additionally, the description of any first element being moved, slid, translated, etc. "relative to" or "along" a second element, does not necessarily mean that the first element is motive while the second is stationary. Rather, consistent with these terms as used herein, a first element may be moved, slid, translated, etc. relative to a second element by driving the first element while holding the second stationary, driving the second element while holding the first stationary, or driving both the first and second elements at the same time, but at different velocities (speed and/or direction).

Figure 15:
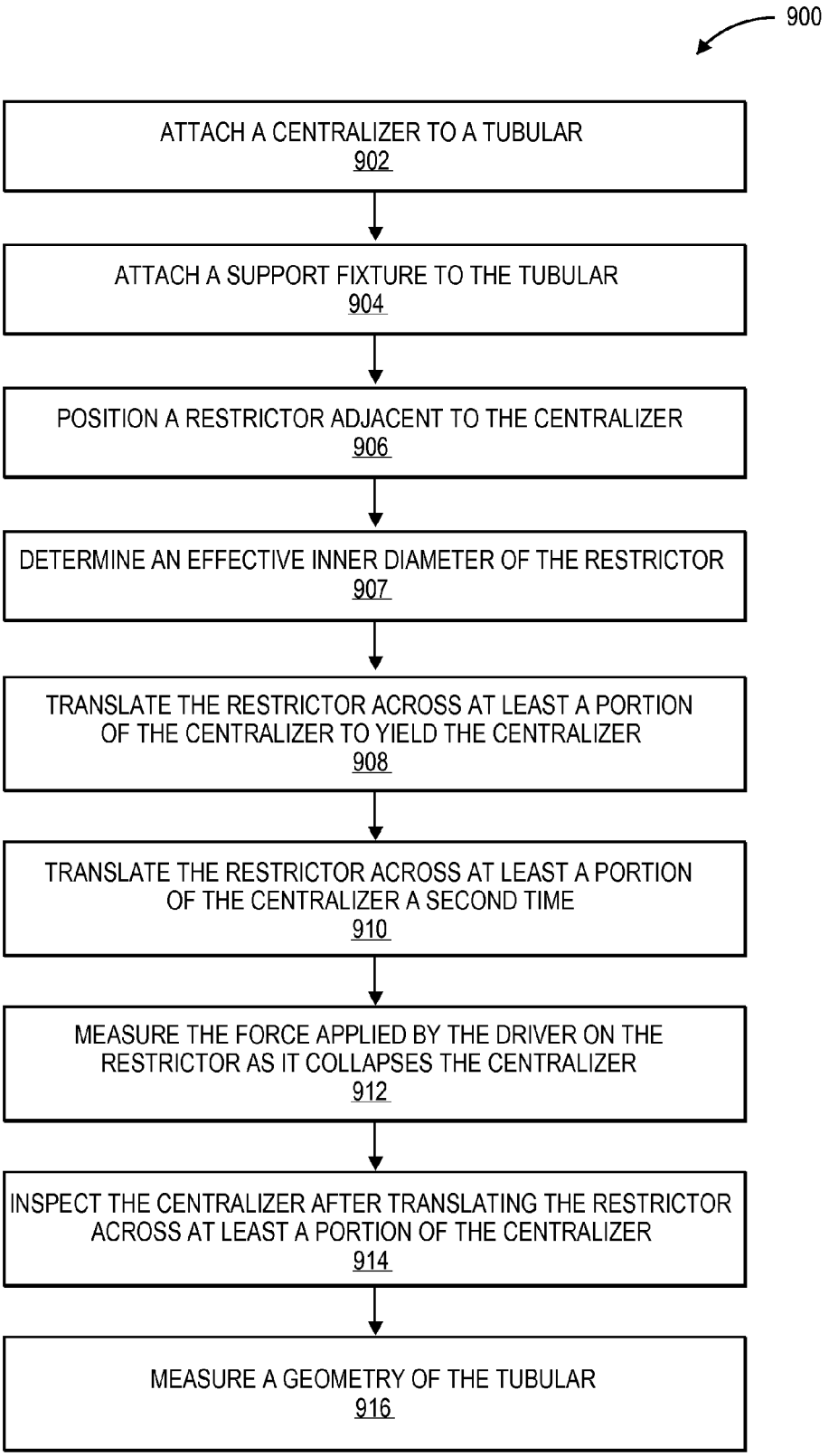
FIG. 15 illustrates a flowchart of a method for preconditioning or testing a centralizer, according to an embodiment.

FIG. 15 illustrates a flowchart of a method 900 for preconditioning and testing a centralizer, according to an embodiment. The method 900 may, in some cases, proceed by operation of one or more embodiments of the apparatus 100 described above, and will thus be described with reference thereto; however, it will be appreciated that the method 900 is not to be considered limited to any particular structure unless otherwise expressly stated herein.

The method 900 may begin by attaching a centralizer 102 to an outer diameter of a tubular 104, as at 902. The centralizer 102 may be attached to the tubular 104 and rotatable therewith or with respect thereto. The centralizer 102 may be a bow-spring centralizer and may have flexible ribs 114 extending between two end collars 115, 117. The ribs 114 may be expandable radially between a radially larger, deployed configuration and a radially smaller, collapsed configuration. Further, the centralizer 102 may have a range of axial motion, so as to axially extend between a first length $L_{C1}$ in the deployed configuration and a second, larger length $L_{C2}$ in the collapsed configuration. In an embodiment, movement of the centralizer 102 may be axially and/or circumferentially limited via one or more stop collars 106, 108 received onto and fixed in position with respect to the tubular 104 using any suitable device and/or process, as described above. In an embodiment, the stop collars 106, 108 may be disposed axially between end collars 115, 117 of the centralizer 102, so as to allow the end collars 115, 117 to move axially apart.

The method 900 may also include attaching a support fixture 116 to the tubular 104, as at 904. The support fixture 116 may resist axial movement of the tubular 104 in at least one direction. For example, the support fixture 116 may be configured to bear on an axial end 110 of the tubular 104, so as to prevent movement of the tubular 104 in a first axial direction $X_1$.

The method 900 may further include positioning a restrictor 118 around the outer diameter of the tubular 104 and axially adjacent to the centralizer 102, as at 906. The restrictor 118 may define an effective inner diameter $IR_R$ that is less than an initial outer diameter $OD_{C1}$ of the centralizer 102, at least when the centralizer 102 is in a deployed configuration (e.g., as shown in FIG. 1).

Before, during, or after disposing the restrictor 118 around the outer diameter of the tubular 104, a value for the effective inner diameter $IR_R$ may be determined, as at 907. In an embodiment, this may include selecting one or more shims 144, which may be received into an inner diameter 137 of the generally cylindrical structure 119 of the restrictor 118, thereby reducing the effective inner diameter $ID_R$. Determining the effective inner diameter $ID_R$ may also include selecting an inner profile for the restrictor 118, which may be tapered, stepped, curved, etc. such that the effective inner diameter $ID_R$ may vary between the axial extents of the restrictor 118.

Further, determining the effective inner diameter $ID_R$ at 907 may include determining a target running force, a target starting force, and/or a target restoring force for the centralizer 102. "Starting force" is defined to mean a force required to begin pulling the centralizer 102 through a certain radius restriction. "Running force" is defined to mean a force required to continue pulling the centralizer 102 through a certain radius at a given speed. "Restoring force" is defined to mean a force applied by the centralizer 102, radially outward, thereby supplying the standoff between the tubular 104 and a surrounding tubular (e.g., wellbore). The selected effective inner diameter $ID_R$ may yield the ribs 114 of the centralizer 102 by a certain amount, which may be determined to result in the centralizer 102 exhibiting the target starting, running, and/or restoring forces.

Determining the size of the effective inner diameter $ID_R$ at 907 may also include considering one or more wellbore conditions and/or geometries. For example, the effective inner diameter $ID_R$ may be selected to be equal to or less than the smallest restriction found in the wellbore. Thus, the ribs 114 of the centralizer 102 may not be expected to experience yielding during deployment into the wellbore after preconditioning using the apparatus 100 and/or method 900. In some cases, the yielding experienced by centralizer 102 during the first time the ribs 114 thereof are collapsed may account for all or nearly all of the deviations in running, starting, and/or restoring forces from the original, unyielded state of the centralizer 102. By yielding the centralizer 102 under controlled conditions prior to deployment using the restrictor 118, unknown deviations in running, starting, and/or restoring forces may be avoided.

With the centralizer 102, support fixture 116, and restrictor 118 in place, in any order, the method 900 may then proceed to translating the restrictor 118 axially with respect to the tubular 104, such that at least a portion of the restrictor 118 slides across at least a portion of the centralizer 102, as at 908. For example, the translating at 908 may include translating the restrictor 118 in the first axial direction $X_1$ toward the support fixture 116. In other embodiments, translating at 908 may proceed by moving the tubular 104 and holding the restrictor 118 in place, for example, as shown in and described above with reference to FIGS. 11 and 12. During the translation at 908, the restrictor 118 may radially collapse at least at least a portion of the ribs 114 of the centralizer 102, and may yield the ribs 114. It will be appreciated that translating at 908 may include multiple passes of the restrictor 118 across all or a portion of the centralizer 102, e.g. with successively smaller effective inner diameters $ID_R$.

Translating at 908 may proceed by moving the restrictor 118 toward the support fixture 116 using the driver 120, e.g., either by moving the restrictor 118 and holding the tubular 104 stationary, moving the tubular 104 and holding the restrictor 118 stationary, or by moving both the tubular 104 and the restrictor 118. For example, translating at 908 may include the winches 139, 140 taking up the flexible connection members 143, 145 so as to pull the restrictor 118 toward the winches 139, 140. Further, the winches 139, 140 may be fixed on the same axial end 110 as the support fixture 116, such that pulling the restrictor 118 results in a force directed along the first axial direction $X_1$, which is taken up by the support fixture 116, so as to keep the tubular 104 in place. In other embodiments, the winch 140 may drawn in the flexible connection member 145, so as to move the tubular 104 by application of force on the end plate 810.

The method 900 may also include translating the restrictor 118 axially across at least a portion of the centralizer 102 a second time, either in reverse direction $X_2$ of the first translation at 908 or in the same direction $X_1$, as at 910. The second time the restrictor 118 translates at least partially across the centralizer 102, the centralizer 102 may not yield, or may yield less than as in the first translating at 908. Thus, during the second pass of the restrictor 118 over the centralizer 102 at 910, the centralizer 102 may perform as it will be expected to in the wellbore, on the specific tubular 104, for example, without inaccuracies due to tubular diameter tolerances. Accordingly, during the second time translating at 910, information related to, e.g., starting and running forces, as measured by the load cell 147, may be logged and associated with the centralizer 102 as being expected to be repeated when the centralizer 102 and tubular 104 are run into the wellbore.

As with the translating at 908, the translating at 910 may proceed by one or multiple passes of the restrictor 118 over at least a portion of the centralizer 102. For example, the second translating at 910 may include multiple passes, for example, to ensure precision in measurements, measurements at multiple effective inner diameters $ID_R$ of the restrictor 118, etc.

During either the first or second translations at 908 and 910, the method 900 may include measuring the forces applied by the driver 120, as at 912, e.g., using the load cell 147. These forces may, for example, be indicative of the starting force (i.e., when the restrictor 118 first encounters the centralizer 102 during a given translation 908, 910) and a running force (i.e., as the restrictor 118 moves across the centralizer 102).

Additionally, the centralizer 102 may be inspected, as at 914, after one, some, or each of the axial translations at 908 and/or 910. For example, a magnetic particle inspection (MPI), or any other inspection can be performed to confirm the absence of cracks in the centralizer 102, thereby increasing confidence in centralizer 102 performance when a restriction is encountered. Once the centralizer 102 is finished being preconditioned, tested, and/or inspected, any elements of the apparatus 100 that are connected to the tubular 104 (e.g., the restrictor 118, driver 120, and/or support fixture 116) may be removed therefrom, and the tubular 104 run into the wellbore, e.g., as part of a drill or casing string.

The method 900 may also include measuring a geometry of the tubular 104, as at 916. For example, a measuring device 812 may be disposed within the tubular 104 and moved relative to the tubular 104. The measuring device 812 may be a drift, configured to measure or confirm concentricity. The measuring device 812 may additionally or instead by an ultrasonic probe configured to measure an inner diameter $ID_T$ of the tubular 104. In at least one embodiment, the measuring device 812 may be both a drift and an ultrasonic probe, or any other measuring device. Further, the measuring device 812 may be coupled with a computing device 814, so as to record measurements taken by the measuring device 812. The load cell 147 may also be attached to the computing device 814. The measuring device 912 may be attached to the driver 120 for example, via one or more of the flexible connection members 143, 145 extending through the tubular 104. Additionally, measuring at 916 may occur during, prior to, or while axially translating the restrictor 118 relative to the tubular 104 at 908 and/or 910.

During measuring at 916, signals indicative of the inner diameter $ID_T$ of the tubular 104 and/or the force required to move the measuring device 812 through the tubular 104 may be recorded by the computing device 814. Such signals may be used to determine the relevant geometry of the tubular 104. For example, the inner diameter $ID_T$ of the tubular 104 at various points along the tubular 104 may be added to thickness of the tubular 104 to map the outer diameter of the tubular 104. Further, the cylindricity of the tubular 104 may be measured.

While the present teachings have been illustrated with respect to one or more implementations, alterations and/or modifications may be made to the illustrated examples without departing from the spirit and scope of the appended claims. In addition, while a particular feature of the present teachings may have been disclosed with respect to only one of several implementations, such feature may be combined with one or more other features of the other implementations as may be desired and advantageous for any given or particular function. Furthermore, to the extent that the terms "including," "includes," "having," "has," "with," or variants thereof are used in either the detailed description and the claims, such terms are intended to be inclusive in a manner similar to the term "comprising." Further, in the discussion and claims herein, the term "about" indicates that the value listed may be somewhat altered, as long as the alteration does not result in nonconformance of the process or structure to the illustrated embodiment. Finally, "exemplary" indicates the description is used as an example, rather than implying that it is an ideal.

Other embodiments of the present teachings will be apparent to those skilled in the art from consideration of the specification and practice of the present teachings disclosed herein. It is intended that the specification and examples be considered as exemplary only, with a true scope and spirit of the present teachings being indicated by the following claims.

What is claimed is:

1. An apparatus, comprising:

a restrictor positionable around a tubular and having an inner diameter that is greater than an outer diameter of the tubular; and a driver configured to translate the restrictor relative to the tubular in at least a first axial direction, wherein the restrictor is configured to engage a centralizer attached to the tubular, and wherein the restrictor is configured to at least partially collapse flexible ribs of the centralizer when the driver axially translates the restrictor across at least a portion of the flexible ribs.

2. The apparatus of claim 1, further comprising one or more restrictor supports connected to the restrictor and configured to restrain the restrictor from movement in at least the first axial direction, wherein the driver is coupled with the tubular and configured to move the tubular with respect to the restrictor.

3. The apparatus of claim 1, further comprising a support fixture configured to be attached to the tubular, such that the support fixture resists movement of the tubular in at least one axial direction with respect thereto, wherein the driver is attached to the restrictor to axially translate the restrictor.

4. The apparatus of claim 3, wherein the support fixture comprises:

a base abutting an axial end of the tubular when the support fixture is secured to the tubular; and a cylindrical plug extending from the base and configured to be received into the axial end of the tubular.

5. The apparatus of claim 3, wherein the support fixture is attached to the driver.

6. The apparatus of claim 1, wherein the driver comprises a load cell configured to measure an axial force applied to the restrictor by operation of the driver.

7. The apparatus of claim 1, wherein the driver comprises one or more of: a winch, a hydraulic arm, or a threaded rod.

8. The apparatus of claim 1, wherein the restrictor comprises a plurality of arcuate members that are attached together and fit around the tubular.

9. The apparatus of claim 8, wherein the restrictor further comprises a hinge attached to two of the plurality of arcuate members, such that the two of the plurality of arcuate members are pivotal one relative to the other.

10. The apparatus of claim 1, further comprising one or more shims, wherein the one or more shims are received into an inner diameter of the restrictor to reduce an effective inner diameter of the restrictor.

11. The apparatus of claim 1, wherein the restrictor defines an axial length that is longer than an axial length of the centralizer in a collapsed configuration.

12. The apparatus of claim 1, wherein the restrictor defines an axial length that is shorter than an axial length of the centralizer in a collapsed configuration.

13. The apparatus of claim 1, wherein the restrictor is a first restrictor, the apparatus further comprising a second restrictor received around the tubular and spaced axially apart from the first restrictor.

14. The apparatus of claim 1, wherein the restrictor comprises one or more rollers configured to support the restrictor as the restrictor moves along the tubular.

15. The apparatus of claim 1, further comprising a cart attached to the restrictor and configured to transfer a weight of the restrictor to a structure external to both the centralizer and the tubular.

16. The apparatus of claim 1, wherein the driver is attached to the restrictor by a flexible connection member.

17. The apparatus of claim 1, further comprising:

a first support fixture configured to engage a first axial end of the tubular, wherein the first support fixture, when engaging the first axial end of the tubular, prevents the tubular from translating in the first axial direction, and wherein the driver is a first driver and is configured to move the restrictor toward the first support fixture;

a second support fixture configured to engage a second axial end of the tubular, wherein the second support fixture, when engaging the second end of the tubular, prevents the tubular from translating in a second axial direction; and a second driver attached to the restrictor and configured to move the restrictor in the second axial direction, opposite to the first axial direction, and axially past and radially over the centralizer.

18. The apparatus of claim 1, further comprising a measurement device sized to be disposed in the tubular, wherein the driver is configured to move the measurement device with respect to the tubular, at least partially through the tubular.

19. The apparatus of claim 18, wherein the measurement device is coupled with the driver via one or more flexible connection members extending through the tubular.

20. The apparatus of claim 18, wherein the measurement device comprises a drift, an ultrasonic probe, or both.

21. A method, comprising:

positioning a restrictor around a tubular and adjacent to a centralizer received around the tubular and having flexible ribs, wherein the restrictor defines an effective inner diameter that is less than an outer diameter of the centralizer; and translating the restrictor with respect to the tubular, at least partially across the centralizer, so as to radially collapse at least a portion of the flexible ribs of the centralizer, which causes the flexible ribs to yield.

22. The method of claim 21, further comprising determining the effective inner diameter of the restrictor based on a target running force, a target starting force, or a combination thereof.

23. The method of claim 21, further comprising determining the effective inner diameter of the restrictor based on a wellbore condition.

24. The method of claim 21, further comprising measuring a force required to axially translate the restrictor across the centralizer.

25. The method of claim 21, further comprising:

after translating the restrictor at least partially across the centralizer, translating the restrictor at least partially across the centralizer a second time; and measuring a force applied to the restrictor while translating the restrictor the second time, wherein the force corresponds to a starting force, a running force, or both of the centralizer.

26. The method of claim 25, wherein the centralizer is substantially free from additional yielding during translating the second time.

27. The method of claim 21, further comprising:

attaching a support fixture to the tubular, wherein the support fixture restrains the tubular from movement in at least one axial direction, wherein translating the restrictor comprises pulling the restrictor toward the support fixture using a driver.

28. The method of claim 27, wherein the driver comprises a winch attached to the support fixture, the method further comprising attaching the winch with the restrictor using flexible connection members extending from the winch.

29. The method of claim 27, further comprising:

removing the restrictor and the support fixture from the tubular.

30. The method of claim 21, further comprising reversing an axial direction of the translation of the restrictor with respect to the tubular.

31. The method of claim 21, further comprising testing a structural integrity of the centralizer after translating the restrictor at least partially across the centralizer.

32. The method of claim 21, further comprising restricting an axial translation of the centralizer using one or more stop collars, wherein, when the centralizer is axially collapsed by the restrictor, the flexible ribs of the centralizer contact an outer diameter of the one or more stop collars.

33. The method of claim 21, further comprising moving a measuring device disposed within the tubular relative to the tubular, so as to measure a geometry of the tubular.

34. The method of claim 21, further comprising attaching a driver to the tubular, wherein translating the restrictor comprises driving the tubular to move using the driver.

35. A system, comprising:

a restrictor configured to be placed over a tubular having a centralizer;

a support fixture attached to an end of the tubular; and a driver attached to the support fixture, the driver being configured to move the restrictor into contact with the centralizer, wherein the centralizer has a first outer diameter prior to contact with the restrictor and a second smaller outer diameter after contact with the restrictor.

36. The system of claim 35, further comprising a load cell attached to the driver, the load cell being configured to measure force applied to the restrictor by the driver, wherein the force corresponds to a starting force, a running force, or both of the centralizer.

* * * * *